US007559202B2

(12) United States Patent
Prociw et al.

(10) Patent No.: US 7,559,202 B2
(45) Date of Patent: Jul. 14, 2009

(54) REDUCED THERMAL STRESS FUEL NOZZLE ASSEMBLY

(75) Inventors: Lev Alexander Prociw, Elmira (CA); Harris Shafique, Longueil (CA); Dany Clarence Gaudet, Longueil (CA)

(73) Assignee: Pratt & Whitney Canada Corp., Longueuil (CA)

( * ) Notice: Subject to any disclaimer, the term of this patent is extended or adjusted under 35 U.S.C. 154(b) by 620 days.

(21) Appl. No.: 11/273,544

(22) Filed: Nov. 15, 2005

(65) Prior Publication Data

US 2007/0107434 A1 May 17, 2007

(51) Int. Cl.
*F02C 7/00* (2006.01)
*F23R 3/30* (2006.01)

(52) U.S. Cl. ..... 60/740; 60/796

(58) Field of Classification Search ..... 60/740, 60/748, 796, 800; 29/890.02; 228/127, 132
See application file for complete search history.

(56) References Cited

U.S. PATENT DOCUMENTS

| | | | | |
|---|---|---|---|---|
| 2,681,696 | A | 6/1954 | Stalego | |
| 2,806,522 | A | 9/1957 | Stalego | |
| 2,836,233 | A | 5/1958 | Schoenmakers et al. | |
| 3,889,093 | A | 6/1975 | Fawcell et al. | |
| 4,125,359 | A | 11/1978 | Lempa | |
| 4,813,608 | A | 3/1989 | Holowach et al. | |
| 4,907,743 | A | 3/1990 | Bouiller et al. | |
| 5,131,583 | A | 7/1992 | Matsumoto | |
| 5,253,810 | A | 10/1993 | Maltby et al. | |
| 5,575,423 | A | 11/1996 | Yuen | |
| 5,579,645 | A | 12/1996 | Prociw et al. | |
| 5,678,769 | A | 10/1997 | Jacobs | |
| 5,761,907 | A | 6/1998 | Pelletier et al. | |
| 6,003,788 | A | 12/1999 | Sedov | |
| 6,082,113 | A | 7/2000 | Prociw et al. | |
| 6,141,968 | A * | 11/2000 | Gates et al. | 60/740 |
| 6,149,075 | A | 11/2000 | Moertle et al. | |
| 6,152,052 | A | 11/2000 | Saxon et al. | |
| 6,289,676 | B1 | 9/2001 | Prociw et al. | |
| 6,289,677 | B1 | 9/2001 | Prociw et al. | |
| 6,357,222 | B1 | 3/2002 | Schilling et al. | |
| 6,823,677 | B2 | 11/2004 | Prociw et al. | |
| 6,863,228 | B2 | 3/2005 | Mao et al. | |
| 2004/0040310 | A1 * | 3/2004 | Prociw et al. | 60/776 |
| 2006/0096291 | A1 | 5/2006 | Lee | |

FOREIGN PATENT DOCUMENTS

| | | |
|---|---|---|
| EP | 0937536 | 6/1999 |
| EP | 1027560 | 8/2005 |
| JP | 1133987 | 5/1989 |
| WO | WO0000770 | 1/2000 |

OTHER PUBLICATIONS

International Search Report of PCT Application No. PCT/CA2006/001856.

* cited by examiner

*Primary Examiner*—Louis J Casaregola
(74) *Attorney, Agent, or Firm*—Ogilvy Renault LLP (PWC)

(57) ABSTRACT

An assembly that includes two components joined by a pre-compressed braze where the compression in the braze is progressively relieved upon relative thermal expansion of the two components. Also disclosed is a process for producing a pre-compressed braze.

10 Claims, 4 Drawing Sheets

REDUCED THERMAL STRESS FUEL NOZZLE ASSEMBLY

TECHNICAL FIELD

The present invention relates generally to an assembly configured to reduce thermal stress of its components upon an increase in temperature, and more specifically to a low thermal stress assembly.

BACKGROUND OF THE ART

It is well known that gas turbine engine fuel nozzle components are required to operate in very severe environments. Commonly the fuel nozzle body component is exposed to high temperature gradients, resulting from ducting both colder fuel and relatively hot compressed air therethrough. These gradients can give rise to very high thermal stresses, to which the fuel nozzle is subjected. Elevated thermal stresses can also arise when different materials with different thermal expansion coefficients are fixed to one another and the temperature varies. Mismanagement of these stresses can result in cracks, leaks and to potential failure of the components. This is especially true in the case of temperature increase when the mechanical resistance of components decreases.

Accordingly, there is a need to provide an improved assembly which better resists thermal growth differential caused by large temperature gradients.

SUMMARY OF THE INVENTION

It is therefore an object of this invention to provide an improved low thermal stress assembly.

In one aspect, the present invention provides a process of manufacturing a low thermal stress assembly including first and second components. The process comprises: fastening the first and second components together by brazing at a liquidus temperature $\gamma$ of the braze; and creating a compressive pre-stress within at least the braze at an ambient temperature $\beta$ by relative thermal contraction of the first and second components.

In another aspect, the present invention provides a low thermal stress assembly comprising: a first component and a second component; and a braze joining the first and second components, the braze being compressively pre-stressed therebetween at an ambient temperature $\beta$ and being progressively relieved of compression upon increase in temperature above $\beta$ due to relative thermal expansion of the first and second components.

In another aspect, the present invention provides a fuel nozzle spray tip assembly for a gas turbine engine, the fuel nozzle spray tip having a neck portion and a head portion, the head portion having a central tip and openings around the central tip; and during operation of the gas turbine engine, the fuel nozzle has relatively hot air being ducted outside the neck portion and through the openings, and relatively colder fuel being ducted within the neck portion and out the central tip, the fuel nozzle includes a body and a spacer within the body such that the fuel is ducted within the spacer and the hot air is ducted outside the body, and wherein the body and the spacer are each exposed to only one of the hot air and the relatively colder fuel, thereby limiting extreme temperature gradients therewithin.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
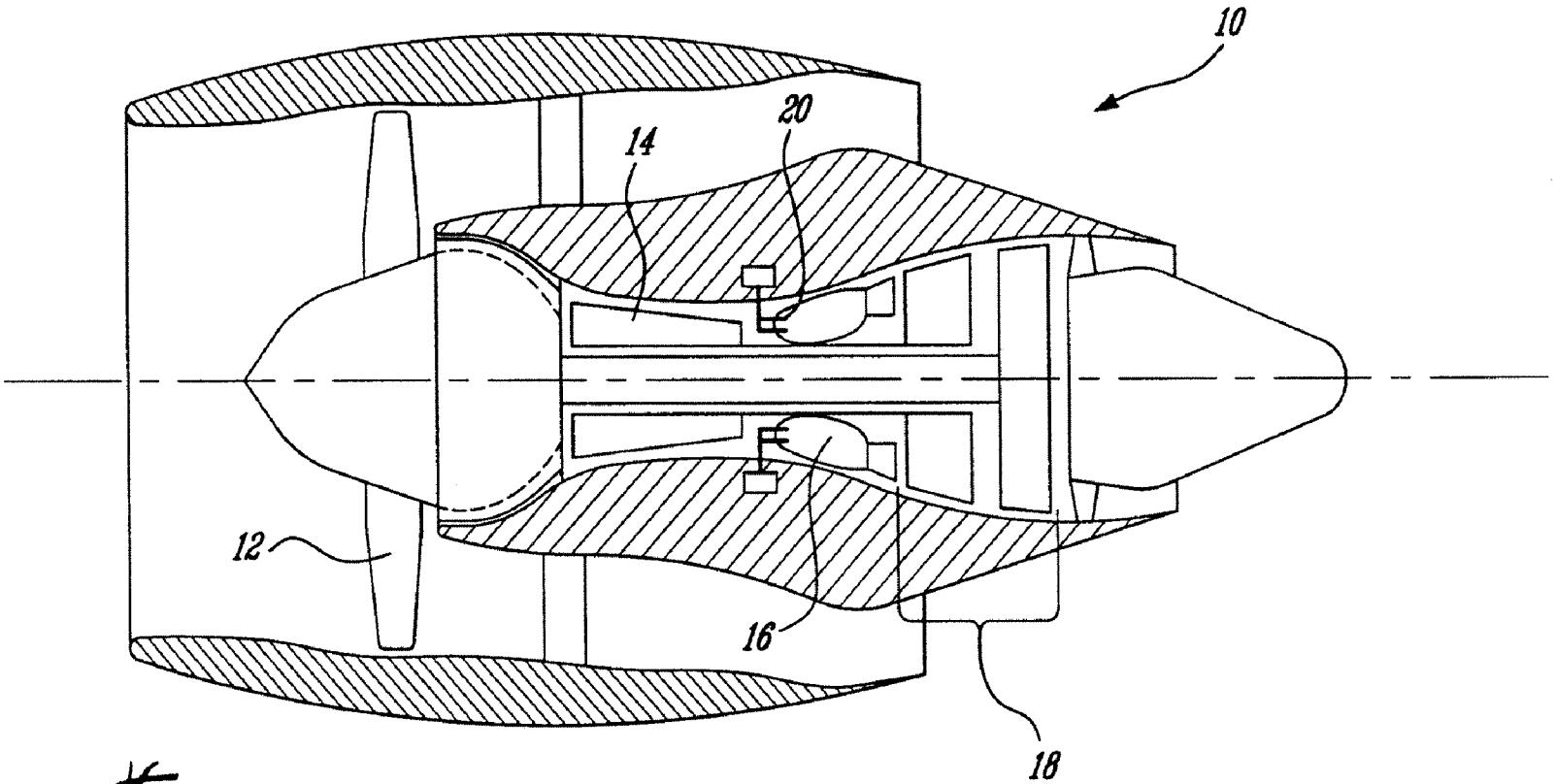
FIG. 1 is a schematic cross-sectional view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases. The fuel is fed within the combustor 16 by means of a fuel nozzle spray tip 20.

Figure 2:
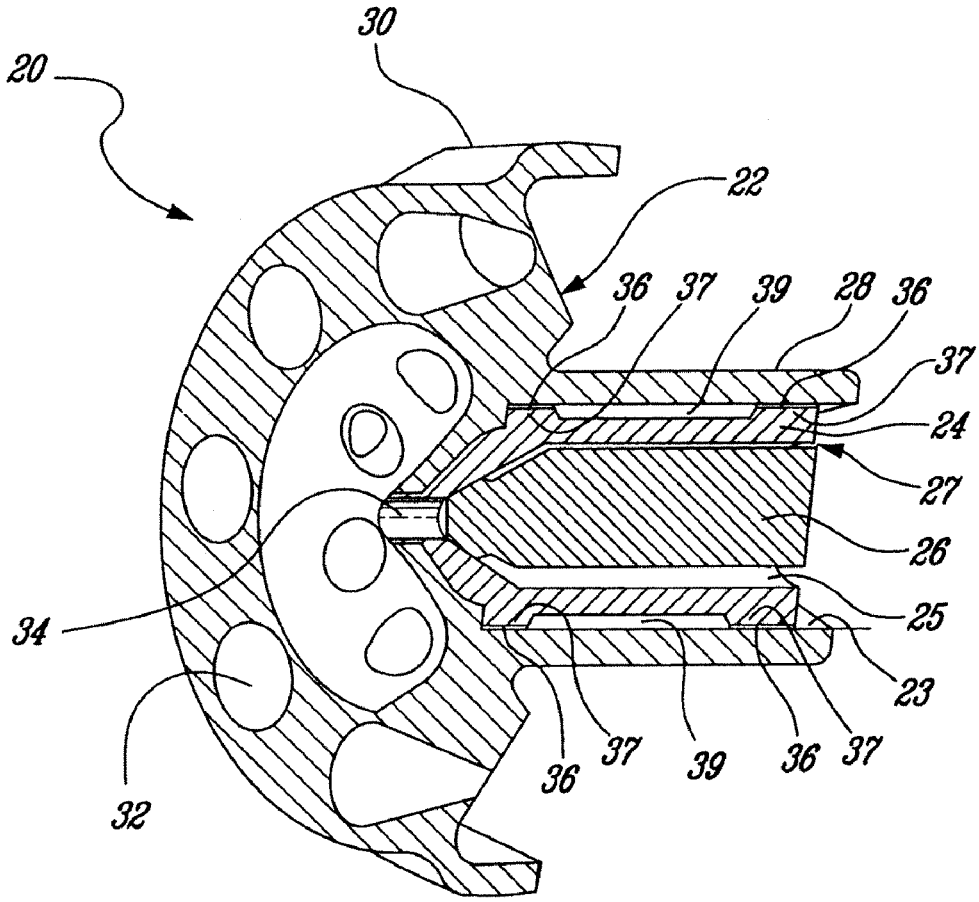
FIG. 2 is a schematic perspective view, partly sectioned, of a low stress fuel nozzle tip in accordance with an embodiment of the invention.

FIG. 2 illustrates a low stress fuel nozzle spray tip assembly 20 which incorporates the invention. The fuel nozzle spray tip assembly 20 preferably comprises three distinct components, namely a body 22, a spacer 24 coaxially mounted in a passage 23 defined within the body 22, and a central swirler 26 itself coaxially mounted within inner passage 25 of the spacer 24. The body 22 includes a neck portion 28 and a head portion 30. The head portion 30 has a central tip 34 which defines at least one fuel flow opening therein through which fuel is ejected, and also has air flow openings 32 disposed around the central tip 34, preferably in a circumferentially spaced manner as is known in the art. During operation of the gas turbine engine 10 (FIG. 1), compressed (and therefore heated) air is ducted outside the neck portion 28 of the body 22 and through the openings 32 in the head portion 30 of the body 22 which provide air swirled around the radially central fuel flow opening of the tip 34. Relatively colder fuel is directed into the annular fuel flow passage 27 defined between the spacer 24 and the central swirler 26, which also helps to meter the fuel flow through the neck portion 28 of the fuel nozzle. Fuel within the fuel flow passage 27 is preferably also swirled by the central swirler 26 which imparts at least some amount of tangential motion to the fuel therein, before the fuel is directed through the central tip 34 for ejection in a spray through the fuel flow opening defined therein.

The spacer 24 is joined to the body 22 by a braze 36 provided in at least one location within the neck portion 28, as described in further detail below. This brazed joint is made, as described in greater detail below, with a relatively large compressive pre-stress within the braze material itself and preferably at least one of the components. Further, the body 22 and spacer 24 are preferably made of dissimilar materials (more preferably dissimilar metals) having differing thermal expansion coefficients. At low temperatures when the engine 10 is inoperative, say room temperature for example, the braze 36 is in compression between the body 22 and the spacer 24. However, when the temperature of the nozzle increases, say to engine operation temperatures for example which are generally quite high in the case of gas turbine engines, the unequal thermal expansion of the body 22 and spacer 24 result in a reduction of the compression within the brazed joint 36 while maintaining a secure bond between the spacer 24 and body 22. This occurs for example when the thermal expansion coefficient of the spacer 24 is lower than that of the body 22.

The latter configuration is especially advantageous in cases where the materials of the spacer 24, body 22 and braze 36 have increased mechanical properties such as material strength at lower temperatures, but lose some of such properties at high temperature, which is the case with most metals. Thus, the compressive stresses occur more importantly at low temperatures where the materials are strongest, and are designed to be substantially reduced at high temperatures where the materials are generally weaker.

Further, another advantage resides in the fact that different components are submitted to the different temperature extremes: the body 22 is submitted to the high temperatures of the hot air around the neck portion 28 thereof, whereas the spacer 24 is submitted to the low temperatures of the cold fuel within the inside surface thereof. The thermal gradients within individual components are thus reduced.

One general concept of the present invention is thus a process of joining two metal components by brazing such that a large compressive pre-stress is created in at least the brazed joint of the composite assembly. When the composite assembly is exposed to normal operating conditions at relatively high temperatures, the braze between the two metal components "relaxes" and the compressive stresses are reduced. This occurs, for example, in the case where two coaxial and nested components are joined by such a compressively pre-stressed braze and the thermal expansion coefficient of the inner component is lower than that of the outer component. This is the case in the previously described fuel nozzle spray tip 20, but can alternatively take place in many other types of assemblies which are exposed to high operation temperatures and/or extreme temperature differentials. Therefore, such a process of jointing two components, preferably of dissimilar materials, together using a compressively pre-stressed joint using a joining material (such as a braze) is applicable in relation with many applications and environments, including those beyond the realm of gas turbine engine and fuel nozzles.

Figure 3A:
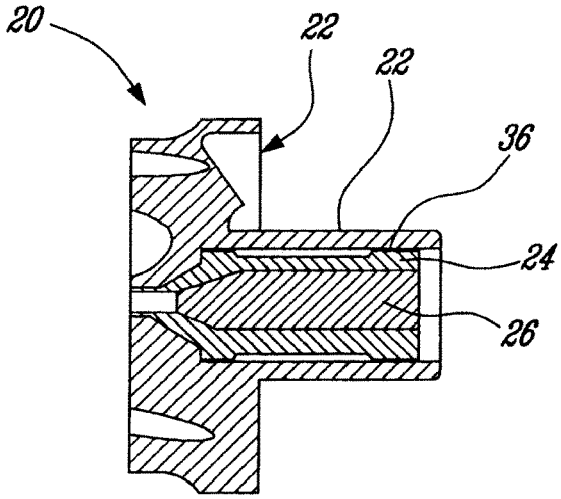
FIG. 3A is a schematic cross-sectional view of the low stress fuel nozzle tip of FIG. 2.
Figure 3C:
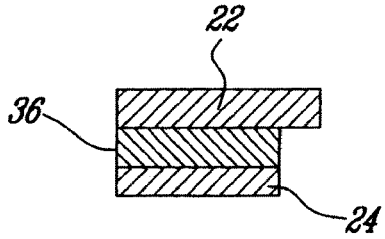
FIG. 3C is a schematic cross-sectional view of components of the fuel nozzle tip of FIG. 3A during a second step of the process.
Figure 3B:
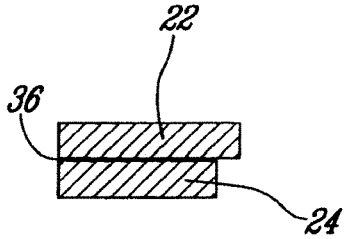
FIG. 3B is a schematic cross-sectional view of components of the fuel nozzle tip of FIG. 3A during a first step of a process in accordance with one embodiment of the invention.
Figure 3D:
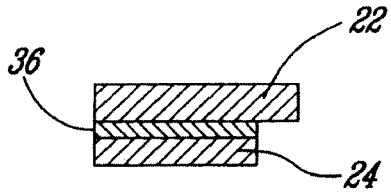
FIG. 3D is a schematic cross-sectional view of components of the fuel nozzle tip of FIG. 3A during a third step of the process.
Figure 3E:
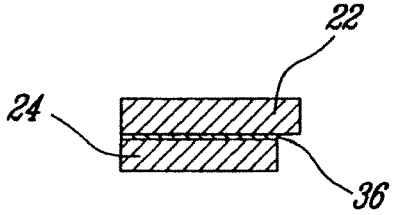
FIG. 3E is a schematic cross-sectional view of components of the fuel nozzle tip of FIG. 3A during a fourth step of the process.

The steps of one process employed to achieve this are schematically depicted in FIGS. 3B to 3E. Step 1 is illustrated in FIG. 3B, and includes assembling a first component 24 and a second component 22, dissimilar from the first component, with a braze filler pre-form placed therebetween. Step 1 is performed at a reference temperature β, which can be ambient room temperature for example. Step 2, is illustrated in FIG. 3C, where the components are heated to a second temperature γ which corresponds to a liquidus temperature of the braze filler perform. The relative gap between the two components 22, 24 (exaggerated in the figures for clarity) increases due to thermal expansion. The melted braze maintains contact with the surfaces of the components 22, 24, such as because of surface tension for example. In step 3, illustrated in FIG. 3D, the parts are cooled to an intermediate temperate δ, which is between temperature β and temperature γ, such that the braze sets and solidifies. During this cooling phase, the material of component 22 contracts faster than that of component 24 due to their difference in thermal expansion coefficients, which results in residual stress forming in component 24 and the braze joint therebetween. The compressive pre-stress so created continues to grow as the assembly gradually returns to ambient temperature β, which is illustrated in FIG. 3E. Thus a compressive pre-stress is formed in the braze joint which joins the first and second components 24 and 22 together. When the assembly so formed is exposed to high temperatures, which in the application to a fuel nozzle would correspond to steady-state turbine operation temperatures for example, the stresses in the joint components is reduced as the relative expansion of the two components reduces the compressive stress within the joint therebetween.

Preferably, the intermediate temperature δ is equal to or higher than the steady-state turbine operation temperatures for the compression stresses to be substantially removed during turbine operation.

Although this manufacturing concept is believed to be of general use in joining many types of materials which are exposed to high operating temperatures, it was developed in order to solve thermal stress issues in turbine engine fuel nozzles where the first component is the spacer 24 and the second component is the body 22 (FIG. 2), as it is illustrated in FIG. 3A.

Figure 4:
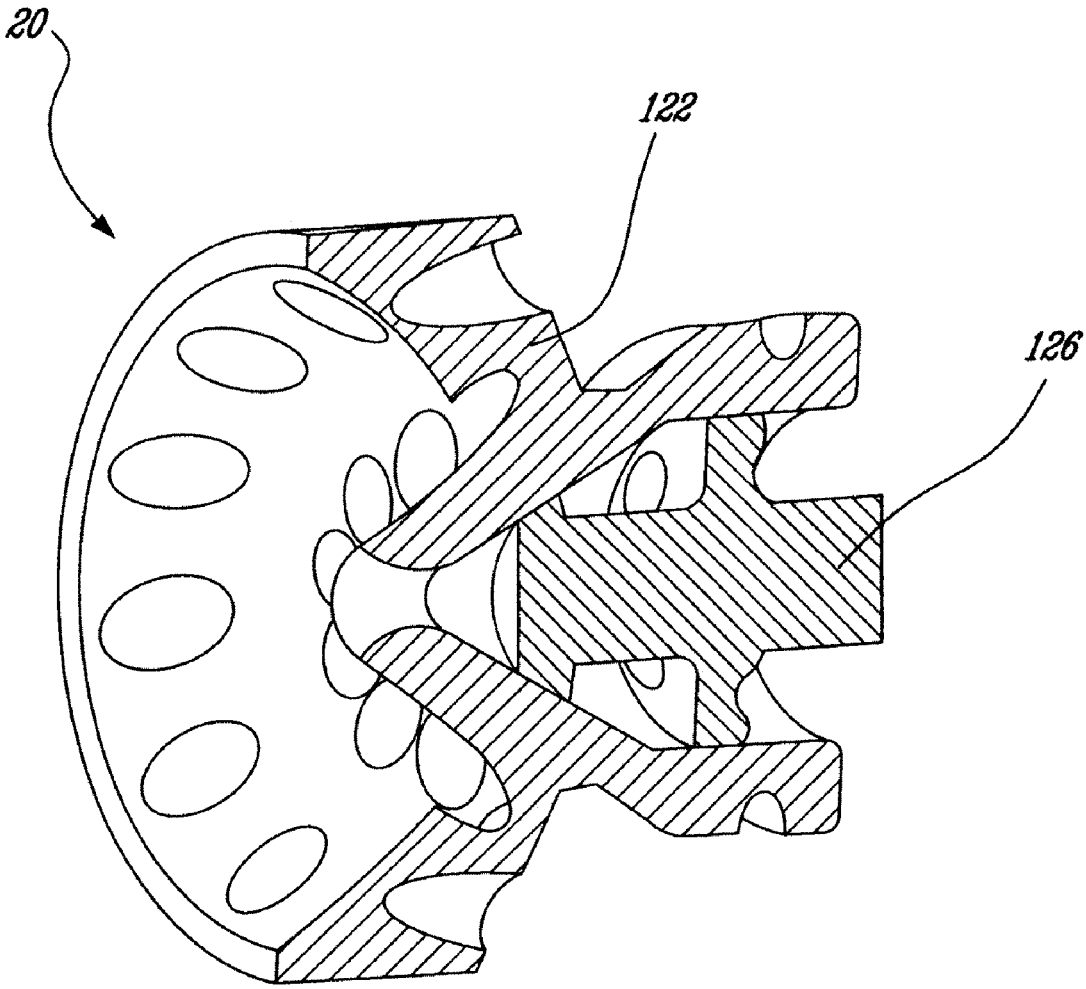
Fig. 4 (PRIOR ART)
FIG. 4 is a sectioned perspective view of a fuel nozzle tip in accordance with the prior art.

Referring back to FIG. 2, it can be seen that the fuel nozzle spray tip 20 comprises a so-called "three piece" fuel nozzle, in which one component (the body 22) is exposed to the compressed (and therefore heated) air directed through the fuel nozzle and a second component (the spacer 24) is exposed to the relatively colder fuel directed through the fuel nozzle. In conventional "two piece" fuel nozzles 120 of the prior art, such as depicted in FIG. 4, the hot air is applied to the outer of the body 122, and the cold fuel is applied to the inner surface of the same body 122. Such a prior art fuel nozzle configuration results in high temperature gradients within the body 122 due to the contrasting temperatures of the hot air and cold fuel being applied to the same component. In the fuel nozzle spray tip 20 of the invention (FIG. 2), the nozzle body is split into two components (22 and 24) in order to limit thermal stress within the nozzle body caused by thermal gradients.

As shown in FIG. 2, the spacer 24 is exposed to the relatively cold temperatures of the fuel flowing therethrough, while the body 22 directs the relatively hot air through the openings 32 defined therethrough. Accordingly, the temperature gradients which form in the fuel nozzle spray tip assembly 20 are significantly reduced as each individual component is exposed to only one of the two temperature extremes. Further, the braze joint therebetween, formed as described above, permits differential expansion at operating temperature, which in fact reduces the thermal stresses at the joints between the components.

As described above, the spacer 24 of the fuel nozzle spray tip assembly 20 is joined to the body 22 thereof by a compressively pre-stressed braze 36, as described above. The spacer 24 is thus fastened by the braze 36 in at least one location within the neck portion 28 of the fuel nozzle body 22. Preferably, the spacer 24 is engaged thereto by two annular brazes 36. Referring to FIG. 2, the spacer 24 preferably includes two radially outwardly protruding ribs 37, one disposed near an upstream end of the neck portion 28 of the nozzle and the other spaced apart downstream therefrom. The two ribs 37 abut the inner surface of the neck portion 28 which faces the passage 23, in press-fit engagement therewith. This press-fit engagement between the spacer 24 and the neck portion 28 of the body 22 helps to ensure a concentricity therebetween, and therefore a concentricity of the fuel and air flows directed therethrough. An annular air gap 39 is thus provided, disposed between the spacer and the neck in a radial direction and between the two spaced apart ribs 37 in an axial direction. The air gap 39 provides thermal insulation between the spacer 24, which is in contact with the cold fuel, and the surrounding neck portion 28 of the nozzle body 22, which is in contact with the relatively hotter air. The braze 36 is thus preferably located in an annular strip between each of the ribs 37 of the spacer 24 and the adjacent inner surface of the neck portion 28 with which they are in press-fit engagement. These two brazes 36 therefore seal the annular air gap 39 therebetween.

The above description is meant to be exemplary only, and one skilled in the art will recognize that changes may be made to the embodiments described without department from the scope of the invention disclosed. For example, although the invention was depicted as being part of a turbofan engine, it can be applied to other types of engines, other engine components, or more broadly, to assemblies in other fields and/or applications where two components are to be joined together by a brazed joint to form an assembly which is to be exposed to high operating temperatures. Another alternative includes the joining of two similar materials, rather than dissimilar ones as per at least one embodiment of the present invention, but wherein differential thermal expansion between the components occurs to increase the gap therebetween. Further still, other applications may use joining materials which do not correspond to the conventional meaning of the word braze but nevertheless provide similar function and work with the invention; the word braze as used herein is intended to be given a broad interpretation which encompasses such alternative joining materials. Still other modifications which fall within the scope of the present invention will be apparent to those skilled in the art, in light of a review of this disclosure, and such modifications are intended to fall within the appended claims.

What is claimed:

1. A low thermal stress fuel nozzle spray tip assembly comprising:

a body of the fuel nozzle spray tip having a passageway therein, a spacer engaged within the passageway of the body, the spacer being hollow and a swirler being disposed within the spacer, wherein an annular passageway is defined between the swirler and the spacer through which fuel is ducted. the swirler being adapted to meter the fuel sprayed out from the fuel nozzle spray tip; and a braze joining the spacer and the body, said braze being compressively pre-stressed at an ambient temperature β and being progressively relieved of compression upon increase in temperature of the assembly above temperature β due to relative thermal expansion of the spacer and the body.

2. The assembly of claim 1 wherein the spacer and the body are composed of dissimilar materials such that the spacer and the body have different coefficients of thermal expansion.

3. The assembly of claim 1 wherein the spacer and the body are arranged in a manner to form a gap therebetween at said temperature β, said gap being greater upon differential thermal expansion of the spacer and the body, and said braze being within said gap.

4. The assembly of claim 1 the spacer and the body are concentric with each other.

5. The assembly of claim 2 wherein the thermal expansion coefficient of the spacer is lower than that of the body.

6. The assembly of claim 1 wherein the body of the fuel nozzle spray tip is adapted to duct hot air on an outside surface thereof, and the spacer of the fuel nozzle spray tip is adapted to duct fuel against an inside surface thereof.

7. The assembly of claim 1 wherein the fuel nozzle spray tip assembly has a neck portion and a head portion, the head portion having a central tip and openings around the tip; and during operation, the fuel nozzle has air being ducted outside the neck portion and through the openings, and relatively colder fuel being ducted within the neck portion and out the central tip, and the fuel being ducted within the spacer while the hot air is ducted outside the body, and the contrasting temperatures of the air and fuel are not directly applied to a single component.

8. A fuel nozzle spray tip assembly for a gas turbine engine, the fuel nozzle spray tip having a body including a neck portion and a head portion, the head portion having a central tip and openings around the central tip, at least the neck portion defining a passageway therein within which is engaged a spacer, and a central swirler being disposed within the passageway of the spacer, an annular passageway being defined between the central swirler and the surrounding spacer, and wherein during operation of the gas turbine engine, the fuel nozzle has relatively hot air being ducted outside the neck portion and through the openings, and relatively colder fuel being ducted through the annular passageway between the central swirler and the spacer within the neck portion and out the central tip, and wherein the body and the spacer are each exposed to only one of the hot air and the relatively colder fuel, thereby limiting extreme temperature gradients therewithin, and wherein the spacer is joined to the neck portion of the body by a braze, the braze being in a compressed state at an ambient temperature β, lower than an operation temperature δ of the braze during steady-state operation of the gas turbine engine, the compression within the braze being progressively reduced upon increase of the temperature of the fuel nozzle towards δ by relative thermal expansion of the body and the spacer.

9. The fuel nozzle of claim 8 wherein the compression within the braze is substantially reduced at a steady-state operation temperature δ of the gas turbine engine.

10. The fuel nozzle of claim 8 wherein the spacer and the body are made of dissimilar metals, the thermal expansion coefficient of the spacer being lower than the thermal expansion coefficient of the body.

* * * * *